US006972088B2

(12) United States Patent
Yehuda

(10) Patent No.: US 6,972,088 B2
(45) Date of Patent: Dec. 6, 2005

(54) PIVOTAL GATE FOR A CATCH BASIN OF A STORM DRAIN SYSTEM

(76) Inventor: Leon H. Yehuda, 7 Gillman St., Irvine, CA (US) 92612

( * ) Notice: Subject to any disclaimer, the term of this patent is extended or adjusted under 35 U.S.C. 154(b) by 59 days.

(21) Appl. No.: 10/654,017

(22) Filed: Sep. 4, 2003

(65) Prior Publication Data

US 2005/0051467 A1 Mar. 10, 2005

(51) Int. Cl.[7] ..... E03F 5/06
(52) U.S. Cl. ..... 210/156; 210/163; 404/4
(58) Field of Search ..... 210/156, 163, 210/164, 170; 404/4, 5

(56) References Cited

U.S. PATENT DOCUMENTS

| | | | | |
|---|---|---|---|---|
| 1,143,496 | A * | 6/1915 | Briles | 210/156 |
| 1,220,123 | A * | 3/1917 | Heybach | 404/4 |
| 1,245,903 | A * | 11/1917 | Gross | 210/163 |
| 2,198,943 | A * | 4/1940 | Lowe | 210/156 |
| 4,418,432 | A * | 12/1983 | Vidal | 210/163 |
| 4,935,129 | A * | 6/1990 | Wang | 210/163 |
| 5,788,849 | A * | 8/1998 | Hutter et al. | 210/163 |
| 6,015,489 | A * | 1/2000 | Allen et al. | 210/163 |
| 6,217,756 | B1 | 4/2001 | Martinez | 210/163 |
| 6,733,665 | B1 * | 5/2004 | Khalil | 210/156 |
| 6,821,053 | B2 * | 11/2004 | Martinez | 404/4 |
| 2004/0069697 | A1 * | 4/2004 | Martinez | 210/163 |
| 2004/0173513 | A1 * | 9/2004 | Nino | 210/156 |

* cited by examiner

*Primary Examiner*—Christopher Upton
(74) *Attorney, Agent, or Firm*—Morland C. Fischer

(57) ABSTRACT

A pivotal gate system to be installed across the drain opening to a catch basin of a storm drain system and having a catch basin blocking gate that is adapted to rotate from a closed position extending completely across the drain opening at which to trap and prevent leaves, litter and other debris from entering the catch basin during dry periods and light rainfall to an open position removed from the drain opening at which to permit rainwater to enter the catch basin during periods of heavy rainfall. A water wheel is mounted for rotation within the catch basin. The water wheel is coupled to the catch basin blocking gate by way of a pulling cable. The water wheel rotates in response to impact forces caused by rainwater dropping downwardly on a plurality of scoops extending around the water wheel. A rotation of the water wheel generates a pulling force in the pulling cable to be applied to the catch basin blocking gate whereby to cause the blocking gate to move from the closed position to the open position.

17 Claims, 5 Drawing Sheets

PIVOTAL GATE FOR A CATCH BASIN OF A STORM DRAIN SYSTEM

BACKGROUND OF THE INVENTION

1. Field of the Invention

This invention relates to a pivotal gate system to be installed across the drain opening of a catch basin or subsurface vault of a typical storm drain system so as to be adapted to rotate from a closed position at which to trap and prevent a collection of leaves and other debris from entering the vault during dry periods or light rainfall to an open position at which to permit rainwater to enter the vault for drainage during periods of heavy rainfall.

2. Background Art

Storm drain catch basins are commonly found along the curbs of roadways to enable rainwater to be drained and carried, by means of a storm drain sewer system, to rivers, lakes and the ocean. However, improperly discarded trash, falling leaves, and other debris are known to line the curb within which a storm drain catch basin is installed. Such trash, leaves and debris will often accumulate only to be blown or pushed into the catch basin opening with little to block the entry thereof. That is to say, with nothing more than the existing cross bar or blocking rod running laterally across the catch basin opening a few inches off the ground, there is simply no effective way to prevent leaves and unwanted debris from falling through the opening and entering the storm drain sewer system.

Accordingly, the storm drain pipes and their associated catch basin may become a temporary storage for trash and debris to be eventually flushed into waterways such as rivers, lakes and the ocean resulting in pollution and contamination. Pollution and contamination of waterways is damaging to human health and the environment. In addition, storm drain pipes and catch basins may also become clogged by the accumulation of unwanted refuse resulting in improper drainage of rainwater causing drainage back-up, whereby the street may become flooded. In this same regard, municipal workers will, from time-to-time, be required to service the catch basins of the storm drains to remove the collection of unwanted refuse therefrom so as to restore unimpeded flow through the storm drain system. When many storm drain catch basins must be regularly serviced, a municipality will be forced to expend both time and money that may be in short supply.

Therefore, what is needed is a means to be installed in the drain opening of a catch basin of a typical storm drain system to trap, block or reduce the entry of unwanted leaves, litter and similar debris without interfering with the flow of rainwater through the catch basin and into the storm sewer system.

SUMMARY OF THE INVENTION

A pivotal gate system is disclosed for installation within a subsurface vault (i.e., a catch basin) so as to block the catch basin drain opening of a typical storm drain system in order to prevent or reduce leaves, litter and other debris from entering the storm drain system. By virtue of the foregoing, the accumulation of trapped refuse can be efficiently collected and more easily removed by municipal workers and/or motorized street sweepers without having to waste time to enter the vault or reach into the storm drain pipes.

The pivotal storm drain system includes a catch basin blocking gate having an upper flap and a lower set of adjustable height bristles that are held together so as to extend completely across the drain opening of the vault. However, a small gap is established between the bottom of the bristles to allow dry weather flow and some of the rain water to pass under the blocking gate. The upper flap and lower bristles of the catch basin blocking gate are carried by a laterally extending coupling channel. A rotatable water wheel is mounted within the interior of the subsurface vault below the drain opening. The water wheel has a plurality of water scoops that extend around the circumference thereof. A pulling cable extends from the water wheel, over a pulley system, for connection to one end of a pull rod. The opposite end of the pull rod is connected to the coupling channel which carries the catch basin blocking gate. A pair of torsion springs engage the coupling channel. The torsion springs are wrapped around a laterally extending mounting rod that is suspended from the ceiling of the subsurface vault to apply a pushing force against the coupling channel and thereby bias the catch basin blocking gate to a normally closed position across the drain opening so that leaves and debris will be trapped and blocked from entering the vault and clogging the catch basin drain opening and the storm sewer system during periods of little or no rainfall.

However, during periods of moderate or heavy rainfall, the rainwater entering the catch basin drain opening via the gap that is established below the set of bristles of the blocking gate will drop on the scoops around the water wheel creating a downward dynamic force to cause the water wheel to rotate. A rotation of the water wheel increases the tension in the pulling cable which, in turn, applies a pulling force to the pull rod. The pulling force applied to the pull rod is transferred to the coupling channel and to the catch basin blocking gate that is carried by the coupling channel. When the pulling force applied to the pull rod overcomes the pushing force generated by the torsion springs, the catch basin blocking gate will rotate around the mounting rod from the closed position across the catch basin opening to an open position at which to permit the unimpeded flow of rainwater into the storm sewer system by way of the catch basin opening and the subsurface vault. A rotation of the catch basin blocking gate causes the torsion springs to become stressed and store energy. Accordingly, when there is a cessation in the flow of rainwater through the drain opening, the tension on the pulling cable will be reduced. In this case, the energy stored in and released by the torsion springs will now be greater than the pulling force applied by the pulling cable to the pull rod, whereby to cause the catch basin blocking gate to automatically rotate from the open position back to the closed position across the catch basin drain opening to await the next rainfall.

DETAILED DESCRIPTION

Figure 1:
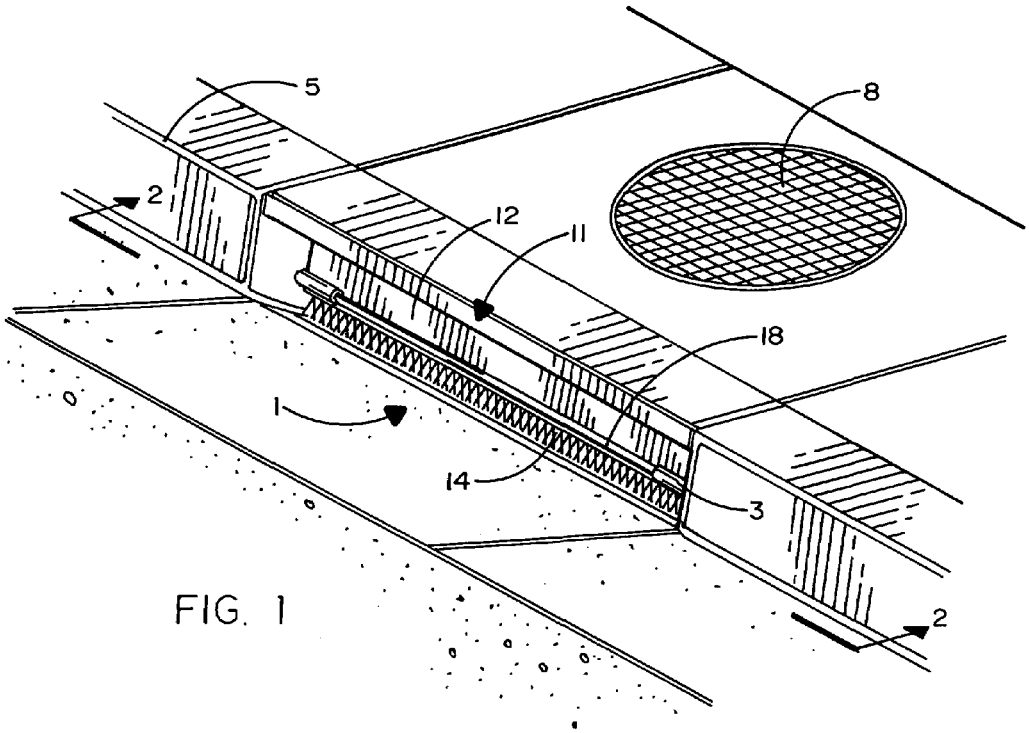
FIG. 1 shows a typical storm drain with the pivotal gate system of this invention installed across the drain opening thereof.
Figure 2:
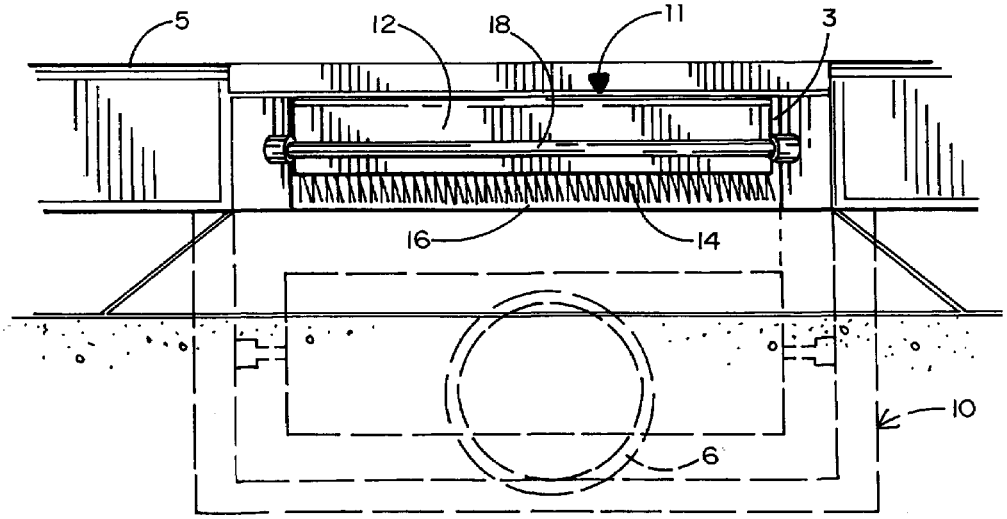
FIG. 2 is a cross-section taken along lines 2—2 of FIG. 1 to show a subsurface vault (i.e., a catch basin) associated with the storm drain of FIG. 1.

Referring initially to FIGS. 1 and 2 of the drawings, there is shown the pivotal catch basin gate system 1 of this invention which represents an improvement over the storm drain systems in use today. As will soon be explained, the catch basin gate system 1 is advantageously and automatically adapted to enable rainwater to be removed from roadways while preventing leaves, litter and other debris from entering and clogging the system during dry periods and polluting the waterways when such debris and litter are flushed into the waterways during rainstorms.

The catch basin gate system 1 is pivotally mounted within the existing catch basin drain opening 3 that is commonly found along the curb 5 of a street. Water run off from a rainfall can now be reliably drained from the street to a waterway via catch basin drain opening 3, an underground sewer pipe 6 and a subsurface catch basin or vault 10 (best shown in FIG. 2). A man hole cover 8 adjacent the catch basin drain opening 3 permits access to the subsurface vault 10 for installation and repair of the catch basin gate system 1 in a flow path between the catch basin drain opening 3 and the sewer pipe 6.

The pivotal catch basin gate system 1 of this invention includes a catch basin blocking gate 11 having a solid, durable (e.g., plastic or high density polyethylene) flap that occupies the top of drain opening 3. Located behind and projecting downwardly from the flap 12 of blocking gate 11 so as to occupy the bottom of the drain opening 3 is a set of generally flexible (e.g., plastic or nylon) bristles 14. A small gap 16 is established between the bottom of the bristles 14 and the street for an important purpose that will be described in greater detail hereinafter. However, it is to be understood that a strainer or similar perforated member may be substituted for the set of bristles 14. The flap 12 and bristles 14 of blocking gate 11 are installed within the catch basin drain opening 3 behind the existing laterally extending blocking bar 18 that is affixed to the curb 5 at opposite ends of drain opening 3.

Figure 3:
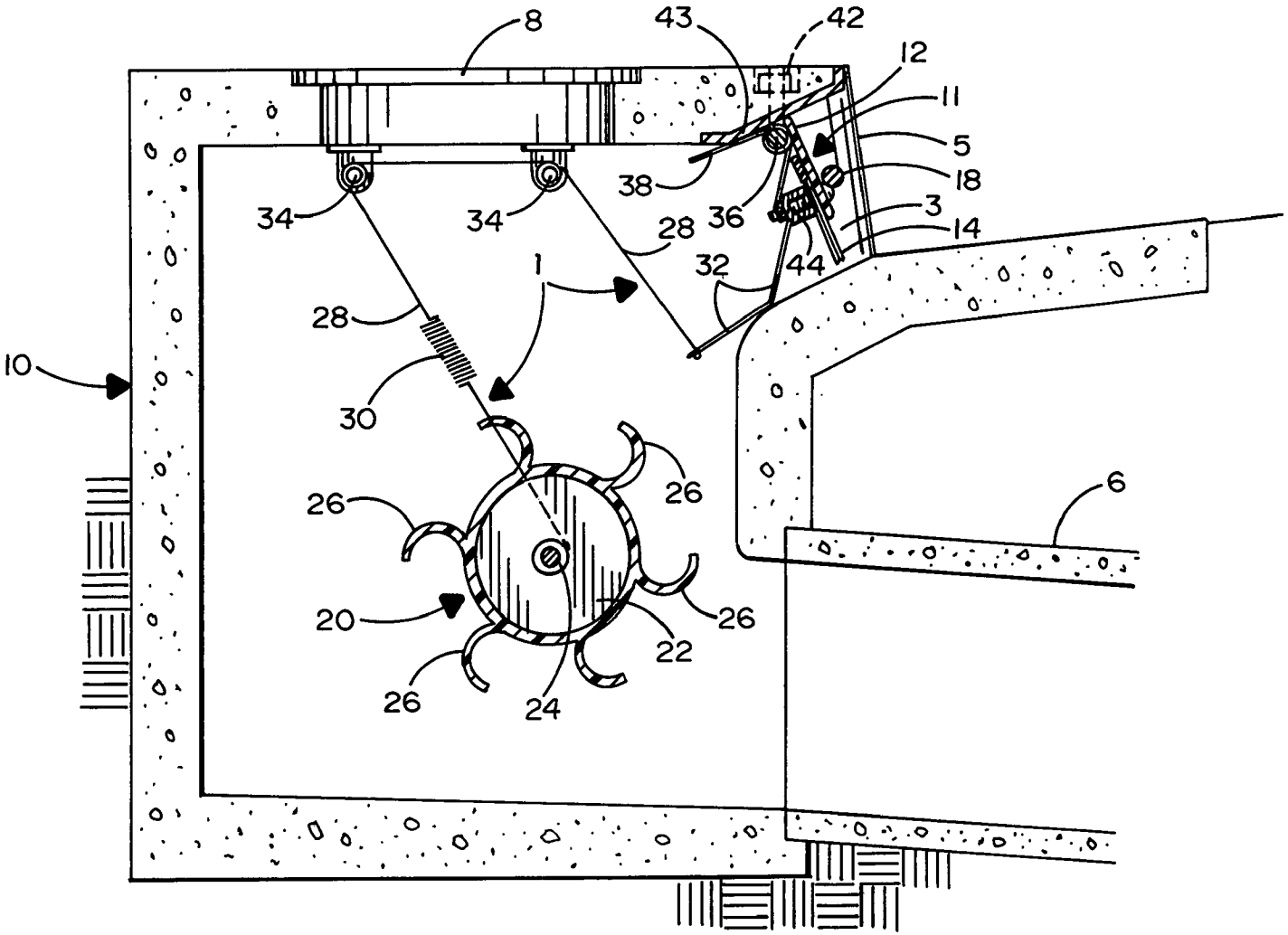
FIG. 3 is a cross-section showing the pivotal gate system mounted at the interior of the subsurface vault of FIG. 2.

FIG. 3 of the drawings shows the catch basin gate system 1 supported at the interior of the catch basin or subsurface vault 10 with the flap 12 and bristles 14 of the catch basin blocking gate 11 in a normally closed position extending completely across the drain opening 3 in the curb 5. The pivotal nature of the catch basin gate system 1 is controlled by a rotatable water wheel 20. Water wheel 20 includes a cylindrical drum 22 that is mounted on an axle 24. The axle 24 of drum 22 is supported for rotation at opposite sides of the subsurface vault 10 (best shown in FIG. 8). Rotation of the water wheel 20 is initiated by a series of arcuate water scoops 26 that are spaced evenly from one another around the circumference of drum 22. In this regard, the rotatable water wheel 20 must be mounted within the vault 10 so that the scoops 26 will be aligned to receive the impact from rainwater which enters drain opening 3.

The rotatable water wheel 20 is coupled to the flap 12 and bristles 14 of catch basin blocking gate 11 by means of a pulling cable 28. One end of the pulling cable 28 is attached to the axle of the drum 22 of rotatable water wheel 20 (also best shown in FIG. 8) by way of a tension spring 30. The opposite end of pulling cable 28 is tied to a pull rod 32 so that a rotation of the water wheel 20 can be translated into a pulling force against pull rod 32. That is, as the drum 22 of water wheel 20 rotates (in the manner best shown in FIG. 7), the tension in the pulling cable 28 will increase to generate a corresponding pulling force against pull rod 32. To ensure that an increased tension in pulling cable 28 is properly transferred to pull rod 32, the cable 28 travels over a series of (e.g., two) pulleys 34 that are connected to and depend downwardly from the ceiling of subsurface vault 10.

The pull rod 32 is shown in FIG. 3 while at rest and lying against the vault 10 above the storm sewer pipe 6 during the dry season or when there is little rainfall. At those times when the pull rod 32 is at rest and the rotatable water wheel 20 is stationary, there is no tension in pulling cable 28, and the flap 12 and bristles 14 of the drain blocking gate 11 of drain gate system 1 remain in the closed position extending completely across the catch basin drain opening 3 so that falling leaves, litter and other undesirable debris will be trapped outside the drain opening 3 to await removal by municipal workers and/or a motorized street sweeper. It may therefore be appreciated that with the flap 12 and bristles 14 of gate 11 in the closed position of FIG. 3, the collection of leaves, litter and debris that is trapped outside the drain opening 3 will be unable to enter the subsurface vault 10. Thus, the drain opening 3 and the storm sewer pipe 6 will not be clogged, and the waterways will not be contaminated when the refuse is flushed during a storm.

A spring 38 is located at each side of the subsurface vault 10 to generate a pushing force that will bias the blocking gate 11 to lie at rest against the existing blocking bar 18 and thereby hold the flap 12 and bristles 14 of catch basin blocking gate 11 in the closed position of FIG. 3 extending completely across drain opening 3 during the dry season or when there is little rainfall. The pushing force applied by the torsion springs 38 may be changed by using different springs or different numbers of springs or adjustable force springs. One end of each torsion spring 38 (only one spring 38 being shown in FIG. 3) is seated against an existing metal plate 43 that is embedded within the ceiling of vault 10. Each torsion spring 38 is then bent around a mounting rod 36 that runs laterally across the interior of vault 10 (best shown in FIG. 6). The mounting rod 36 is suspended from the ceiling of the vault 10 by means of a pair of oppositely aligned anchors 42. The anchors 42 (best shown in FIGS. 5 and 6) project downwardly from the ceiling at opposite sides of the vault 10 such that the mounting rod 36 extends between the anchors just below the vault ceiling.

Figure 4:
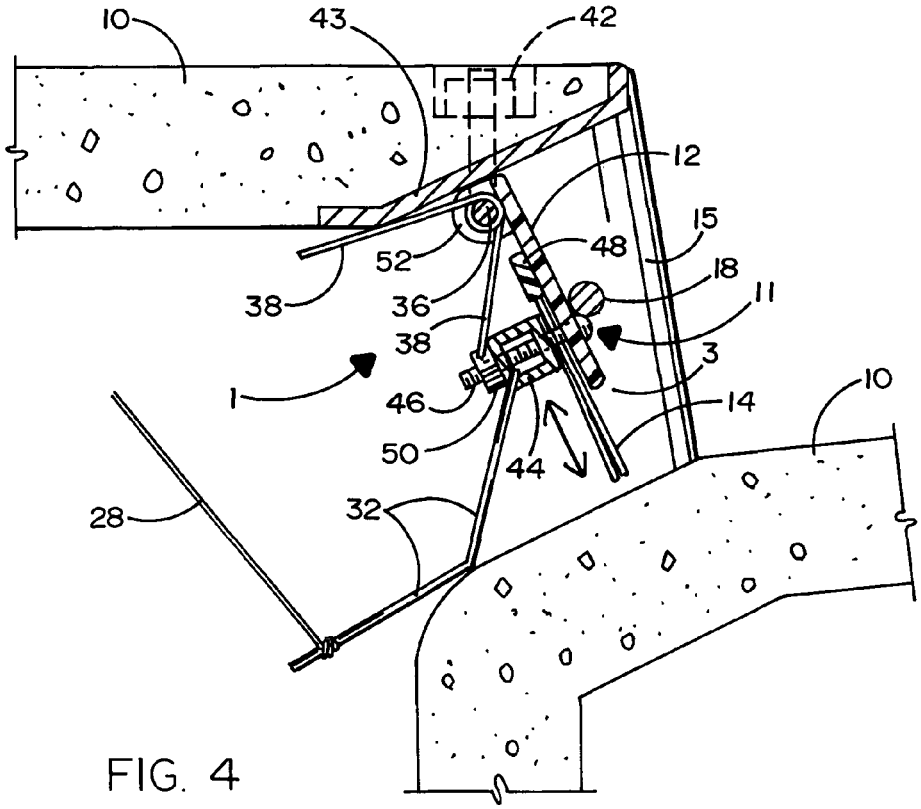
FIG. 4 is an enlarged detail showing a catch basin blocking gate of the pivotal gate system in a closed position extending completely across the opening of the vault of FIG. 2.

Each of the pull rod 32 and the return spring 38 shown in FIG. 4 terminate at a hollow coupling channel 44 which functions as a backing or stiffener to support the flap 12 and bristles 14 of catch basin blocking gate 11. A plurality of threaded fasteners 46 (best shown in FIG. 6) extend through the coupling channel 44 as well as the set of bristles 14 and the flap 12 of blocking gate 11 so that the coupling channel 44 and the blocking gate 11 are connected to one another, whereby a displacement of coupling channel 44 will be imparted to the flap 12 and bristles 14 of blocking gate 11. The tops of the set of bristles 14 are held together by means of an elongated head 48 that is disposed behind flap 12.

Figure 5:
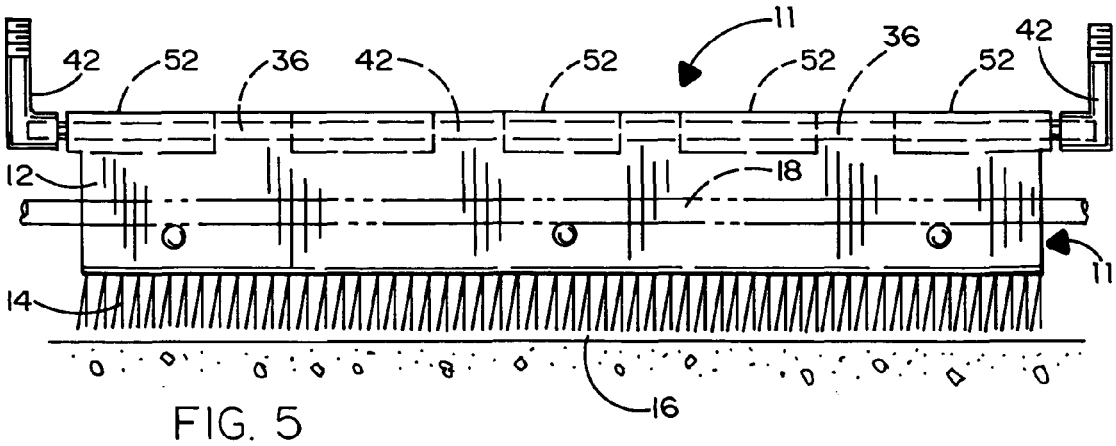
FIG. 5 is a front view of the catch basin blocking gate of FIG. 4 in the closed position.
Figure 6:
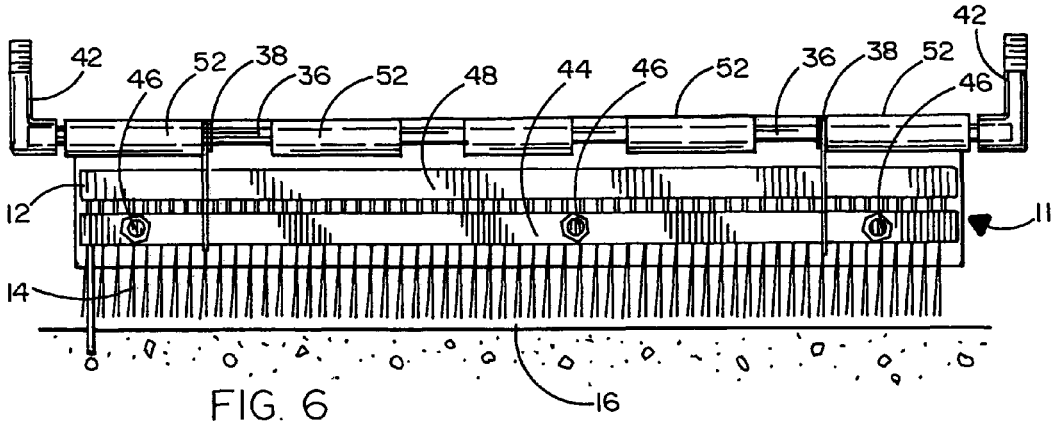
FIG. 6 is a rear view of the catch basin blocking gate of FIG. 4 in the closed position.

A series of hollow cylindrical pivots 52 are spaced from one another along the top of the flap 12 of drain blocking gate 11 (best shown in FIGS. 5 and 6). Each pivot 52 is integrally formed with the flap 12. The mounting rod 36 which is supported by opposing anchors 42 so as to lie below the vault ceiling and run laterally across the interior of the subsurface vault 10 is received through each of the hollow cylindrical pivots 52 at the top of flap 12. By virtue of coupling the mounting rod 36 to the catch basin blocking gate 11 at the cylindrical pivots 52 of flap 12, the blocking gate 11 is adapted to rotate around mounting rod 36 in response to a pulling force that is transferred to the coupling channel 44 to which gate 11 is connected from the pulling cable 28 and the pull rod 32.

The vertical position of the set of bristles 14 relative to the coupling channel 44 may be selected to correspondingly vary the size of the gap 16 between the bottom of the catch basin blocking gate 11 and the street. In this way, the blocking gate 11 can be modified for use with different roadway surfaces. Once the vertical position of the set of bristles 14 has been selected, threaded nuts 50, which surround the threaded fasteners 46, are tightened down against the coupling channel 44 to preserve the position of the bristles 14 and enable the flap 12 and bristles 14 of blocking gate 11 to be displaced as a unit and rotated around mounting rod 36 whenever a suitable pulling force is applied from pulling cable 28 to the pull rod 32 to be transferred to coupling channel 44.

In FIGS. 4–6, the water wheel 20 will remain stationary in response to a period of dryness or little rainfall. Accordingly, there will be no increase in tension along the pulling cable 28, and the pull rod 32 will remain at rest. Since no pulling force is being applied to pull rod 32, the normal bias of the torsional springs 38 will cause a pushing force to be exerted on the coupling channel 42 to hold the catch basin blocking gate 11 in the closed position with the flap 12 and the set of bristles 14 thereof extending completely across the drain opening 3 to trap the accumulation of leaves, litter, etc. to await removal by municipal workers.

Figure 7:
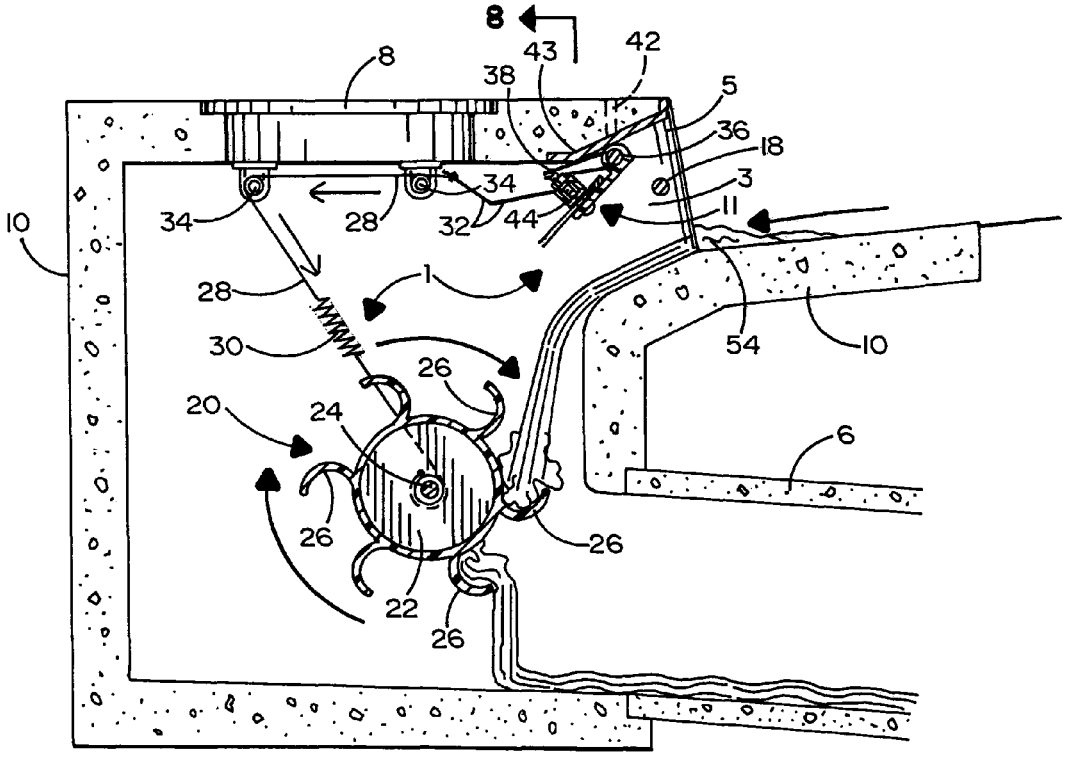
FIG. 7 is a cross-section showing the catch basin blocking gate of the pivotal gate system rotated to the open position.
Figure 8:
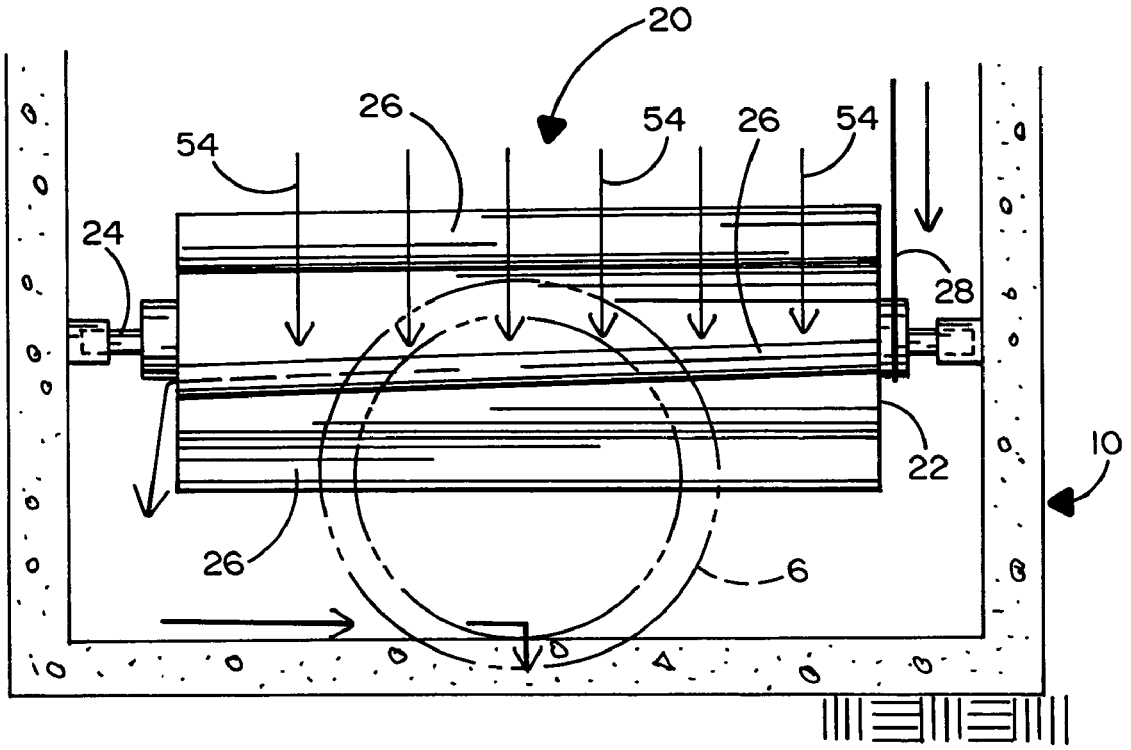
FIG. 8 is a front view of a rotating water wheel of the pivotal gate system taken along lines 8—8 of FIG. 7.

However, in the event of a rainfall, and turning to FIGS. 7 and 8 of the drawings, rainwater 54 will pass between the set of bristles 14 and through the gap 16 below the bristles 14 of catch basin blocking gate 11. As is best shown in FIG. 7, the rainwater 54 will create a downward force on the scoops 28 attached to the drum 22 of rotatable water wheel 20. The downward force created by falling rainwater 54 causes the water wheel 20 to rotate in a clockwise direction around axle 24. As the water wheel 20 rotates, the cable 28 will wind around axle 24 so as to stretch tension spring 30 and increase the tension along pulling cable 28. The taught pulling cable 28 now applies a corresponding pulling force to pull rod 32 to cause the pull rod to move off its at rest position against the subsurface vault 10. The pulling force applied to pull rod 32 is transferred to the coupling channel 44 to which pull rod 32 is connected.

Once the pulling force being transferred from the pull rod 32 to coupling channel 44 exceeds the pushing force applied to coupling channel 44 by the torsion springs 38, the coupling channel 44 will be pulled away from the catch basin drain opening 3 and the blocking gate 11 that is connected to coupling channel 44 will automatically rotate around the laterally extending mounting rod 36 from the closed position of FIG. 4 to the open position FIG. 7. The rain water 54 will now rush through the drain opening 3 and into the subsurface vault 10 to impact scoops 26 and thereby cause the water wheel 20 to continue to rotate in the clockwise direction until the catch basin blocking gate 11 has been completely opened. In this same regard, each of the scoops 26 of water wheel 20 is preferably angled or slanted downwardly (best shown in FIG. 8) to ensure that any water collected by scoops 26 will be quickly emptied for removable by sewer pipe 6. It may be appreciated that with no refuse entering the storm drain to clog the catch basin opening 3 or the vault 10, nothing will impede the flow of rainwater to the sewer pipe 6 so as to avoid a water back-up and possible street flooding.

A displacement of the coupling channel 44 away from catch basin drain opening 3 and a rotation of the catch basin blocking gate 11 around the laterally extending mounting rod 36 to the open position of FIG. 7 causes the torsion springs 38 that are wrapped around the mounting rod 36 to be torsioned against respective plates 43 at the ceiling of vault 10 such that the torsion springs 38 will store energy. When the catch basin blocking gate 11 reaches the open position, the dynamic forces created by the rainwater falling on the scoops 26 will maintain the water wheel 20 in a stationary position balanced by the tension on pulling cable 28 and the pushing force applied by spring 38. Once the rainfall stops, there will be little or no water entering the drain opening 3 to maintain the downward force on the scoops 26 of water wheel 20. Accordingly, the torsion springs 38 will now expand and release their stored energy. The stored energy released by the return springs 38 will be applied as a pushing force to the coupling channel 44, whereby to push the coupling channel 44 towards catch basin opening 3 and thereby cause the catch basin blocking gate 11 that is connected to coupling channel 44 to rotate in an opposite direction around the mounting rod 36 from the open position of FIG. 7 back to the closed position of FIG. 3 at which the blocking gate 11 will once again extend completely across the drain opening to await the next rainfall.

The rotation of blocking gate 11 back to the closed position causes the pull rod 32 to return to its at rest position against the vault 10. As the pull rods 32 returns to its at rest position (of FIG. 3), the pulling cable 28 will unwind from axle 24 of drum 22 to cause the water wheel 20 to rotate in a counter-clockwise direction.

This counter-clockwise rotation of the water wheel 20 will cause any debris that was carried by the rainwater 54 which entered the catch basin opening 3 and was collected in scoops 26 to be dropped therefrom so as to maintain the water wheel 20 and scoops 26 clean and ready for their next use.

The catch basin gate system 1 is once again ready to trap and block leaves, litter and debris so as to prevent such refuse from entering the storm drain system with the possibility of contaminating and polluting the waterways to which the refuse is flushed. Moreover, gate system 1 is now repositioned to avoid the clogging of the catch basin drain opening 3 and subsurface vault 10 during periods of little or no rain so as to be capable of successfully overcoming the problem that has heretofor plagued conventional storm drains.

I claim:

1. A gate system to be located at the opening to a subsurface catch basin of a storm drain system to block leaves, litter and other debris from entering the catch basin during periods of dryness or little rainfall, said gate system comprising:

a catch basin blocking gate extending in a closed position across the catch basin opening to trap said leaves, litter and debris;

at least one torsion spring coupled to said catch basin blocking gate to apply a pushing force thereto by which to hold said blocking gate in the closed position across the catch basin opening during a period of little or no rainfall; and a pull rod to which a pulling force is applied during a period of rainfall by a rain water responsive force generator, said pull rod coupled between said force generator and said catch basin blocking gate to transfer said pulling force to said blocking gate during the period of rainfall by which to overcome the pushing force applied by said at least one torsion spring and thereby pull said catch basin blocking gate to an open position out of the catch basin opening to permit rainwater to flow through the catch basin opening and into the catch basin, said at least one torsion spring being wound and storing energy when said pull rod transfers said pulling force to said catch basin blocking gate during the period of rainfall and said catch basin blocking gate is pulled to said open position, and said at least one torsion being unwound and releasing the stored energy during a subsequent period of little or no rainfall by which to push said catch basin blocking gate back to said closed position.

2. The gate system recited in claim 1, wherein said rainwater responsive force generator comprises a water wheel mounted for rotation within the catch basin, said water wheel adapted to rotate during the period of rainfall to generate said pulling force to be applied to said pull rod and transferred to said catch basin blocking gate for pulling said catch basin blocking gate from said closed position to said open position and causing said at least one torsion spring to be wound to store energy.

3. The gate system recited in claim 2, further comprising a pulling cable extending from said water wheel to said pull rod, the tension in said pulling cable increasing when said water wheel rotates during the period of rainfall to generate said pulling force to be applied to and transferred by said pull rod for pulling said catch basin blocking gate from said closed position to said open position.

4. The gate system recited in claim 3, wherein said pulling cable winds around said water wheel to increase the tension in said pulling cable when said water wheel rotates during the period of rainfall to generate said pulling force to be applied to and transferred by said pull rod to said catch basin blocking gate.

5. The gate system recited in claim 2, wherein said water wheel has a plurality of scoops positioned therearound, said plurality of scoops sloping downwardly across said water wheel and receiving an impact force by rainwater entering the catch basin opening during the period of rainfall to cause said water wheel to rotate and thereby generate said pulling force to be applied to and transferred by said pull rod for pulling said catch basin blocking gate from said closed position to said open position and causing said at least one torsion spring to be wound and store energy, the rainwater entering the catch basin running off said downwardly sloping scoops.

6. The gate system recited in claim 1, further comprising a mounting rod supported within the catch basin, said catch basin blocking gate coupled to and rotating around said mounting rod when said blocking gate moves from said closed position to said open position.

7. The gate system recited in claim 6, wherein said at least one torsion spring for applying said pushing force to said catch basin blocking gate is wrapped around said mounting rod.

8. The gate system recited in claim 6, wherein said mounting rod is suspended from the ceiling of the catch basin by a pair of anchors that project downwardly from the ceiling so that said mounting rod runs laterally through the catch basin above the catch basin opening.

9. The gate system recited in claim 6, wherein said catch basin blocking gate has at least one pivot to surround said mounting rod, whereby said blocking gate is coupled to and rotatable around said mounting rod from said closed position to said open position.

10. The gate system recited in claim 1, wherein said catch basin blocking gate includes a set of bristles spaced above the roadway to establish a gap therebetween through which rainwater will flow during the period of rainfall for causing said blocking gate to move from the closed position to the open position.

11. The gate system recited in claim 10, wherein the vertical position of the set of bristles of said catch basin blocking gate is adjustable relative to the roadway to cause a corresponding change in the size of said gap.

12. A gate system to be located at the opening to a subsurface catch basin of a storm drain system to block leaves, litter and other debris from entering the catch basin during periods of dryness or little rainfall, said gate system comprising:

a catch basin blocking gate extending in a closed position across the catch basin opening to trap said leaves, litter and debris;

spring means coupled to said catch basin blocking gate to apply a pushing force thereto by which to hold said blocking gate in the closed position across the catch basin opening;

a water wheel mounted within the catch basin and coupled to said catch basin blocking gate, said water wheel having a hub so as to be adapted to rotate in a first direction during a period of rainfall for generating a pulling force to be applied to said catch basin blocking gate to overcome the pushing force applied by said spring means for pulling said blocking gate from the closed position across the catch basin opening to an open position out of the catch basin opening so as to permit rainwater to flow through the catch basin opening and into the catch basin; and a flexible cable extending between the hub of said water wheel and said catch basin blocking gate, said flexible cable being wrapped around said hub by which to increase the tension in said flexible cable when said water wheel rotates in said first direction during the period of rainfall to transfer the pulling force generated by said water wheel to said catch basin blocking gate for pulling said blocking gate from said closed position to said open position.

13. The gate system recited in claim 12, further comprising a pull rod connected between said flexible cable and said catch basin blocking gate to apply to said blocking gate the pulling force generated by said water wheel and transferred by said flexible cable during the period of rainfall for pulling said blocking gate from the closed position to the open position.

14. The gate system recited in claim 12, wherein said spring means is a torsion spring that is wound for storing energy when said water wheel rotates in the first direction during the period of rainfall to generate the pulling force to be transferred to said catch basin blocking gate for pulling said blocking gate to said open position, said torsion spring being unwound and releasing the stored energy during a subsequent period of little or no rainfall by which to push said blocking gate back to said closed position and cause said water wheel to rotate in an opposite direction.

15. The gate system recited in claim 12, wherein said catch basin blocking gate includes a debris blocking member spaced above the roadway to establish a gap therebetween through which water will flow during the period of rainfall, the vertical position of said debris blocking member being adjustable relative to the roadway to cause a corresponding change in the size of the gap.

16. The gate system recited in claim 12, wherein said water wheel has a plurality of scoops positioned therearound, said plurality of scoops sloping downwardly across said water wheel and receiving an impact force by rainwater entering the open catch basin during the period of rainfall to cause said water wheel to rotate and thereby generate said pulling force to be applied to and transferred by said flexible cable for pulling said catch basin blocking gate from said closed position to said open position and causing said spring means to be wound and store energy, the rainwater entering the catch basin running off said downwardly sloping scoop.

17. A gate system to be located at the opening to a subsurface catch basin of a storm drain system to block leaves, litter and other debris from entering the catch basin during periods of dryness or little rainfall, said gate system comprising:

a catch basin blocking gate extending in a closed position across the catch basin opening to trap said leaves, litter and debris;

a spring coupled to said catch basin blocking gate to apply a pushing force thereto by which to hold said blocking gate in the closed position across the catch basin opening; and a pull rod to which a pulling force is applied during a period of rainfall by a rainwater responsive force generator, said pull rod coupled between said force generator and said catch basin blocking gate to transfer said pulling force to said blocking gate during the period of rainfall by which to overcome the pushing force applied by said spring and thereby pull said catch basin blocking gate to an open position out of the catch basin opening to permit rainwater to flow through the catch basin opening and into the catch base, said catch basin blocking gate including a debris blocking member spaced above the roadway to establish a gap therebetween through which water will flow during the period of rainfall, the vertical position of said debris blocking member being adjustable relative to the roadway and to the gate to cause a corresponding change in the size of the gap.

* * * * *